US005121927A

United States Patent [19]

Jones

[11] Patent Number: 5,121,927

[45] Date of Patent: Jun. 16, 1992

[54] CHECKERBOARD GAME THAT ACTIVATES WATER THROWING DEVICE

[76] Inventor: Michael J. Jones, 4703 Bay Willow Ct., Orlando, Fla. 32808

[21] Appl. No.: 669,776

[22] Filed: Mar. 15, 1991

[51] Int. Cl.[5] ..... A63F 3/02; A63F 9/24

[52] U.S. Cl. ..... 273/238; 273/287; 273/260; 273/288

[58] Field of Search ..... 273/237, 238, 287, 260, 273/288

[56] References Cited

U.S. PATENT DOCUMENTS 3,733,074 5/1973 Daley ..... 273/238
3,907,301 9/1975 Adcock et al. ..... 273/287
4,113,259 9/1978 Sands ..... 273/287
4,343,609 8/1982 Cardinal ..... 273/238

*Primary Examiner*—Benjamin Layno
*Attorney, Agent, or Firm*—Allen, Dyer, Doppelt, Franjola & Milbrath

[57] ABSTRACT

A game apparatus and method for using the same. The game apparatus includes a game piece placed on a game board. The game board has a circuit which contains a first and second set of terminals that penetrate through the top surface of the game board. Each terminal set is wired to a power source and a pump. The game piece has different chip types with a uniquely shaped conductive surface. The chip is placed on the board over the terminals. Then the chip's conductive surface is forced to contact either the first or second set of terminals to close a circuit and activate one of the pumps.

13 Claims, 2 Drawing Sheets

CHECKERBOARD GAME THAT ACTIVATES WATER THROWING DEVICE

BACKGROUND OF THE INVENTION

This invention relates to a game apparatus and method where the players place pieces over positions on the board and then activate an electronic or electromechanical device, depending on the location of the piece on the board. More particularly, this invention relates to a method of playing checkers and activating pumps to spray the players with water in accordance with the position of the checker on the board.

Examples of board games and playing pieces include checkers, chess, backgammon, etc. In those games the player places the playing pieces on preset locations on the board. Through a series of moves, in accordance with predetermined rules, the players move their pieces and capture the other player's pieces. In accordance with the agreed upon rules the player who eliminates the other player's pieces, or places their pieces in a predetermined position wins the game.

To improve the fun of the games various boards have been wired with electronics. Some example games are disclosed in U.S. Pat. Nos. 927,583, 2,799,505, 3,194,560 and 3,697,076. Other example board games incorporating electronics include GB 939,190, Netherlands 7,808,718, Soviet Union 1,174,049A and German DE 3,503,764A1.

In checkers, it is desirable to have round pieces that are freely oriented on the board. It is also desirable to place one piece on top of another piece during the play of the game. A drawback to many of the above mentioned game boards is that the pieces must fit into a particular slot on the board and thus are not adaptable for fitting one piece on top of another piece while playing the game. Another drawback to the prior games is that the pieces must be oriented in a particular manner for the game to work. Adjusting the orientation may distract from the game.

SUMMARY OF THE INVENTION

An object of the invention is to provide an improved game apparatus.

A further object of the invention is to use a game piece that activates an electromechanical device by completing a circuit regardless of the game pieces' orientation on the board.

Another object of the invention is to provide a method for placing a first game piece on a location on a game board, activating an electromechanical device and then placing a second game piece on the same location on the game board and activating another electromechanical device, irrespective of the pieces' orientation.

An additional object of the invention is to rest a game piece on a board that depresses to contact terminals on the board and complete an electrical circuit.

It is also an object of this invention to position game pieces on a board with one game piece on top of another when moving the pieces.

Another object of the invention is to activate a pump that sprays water at game participants in response to a piece contacting terminals on the surface of a game board.

These and other objects are accomplished with a game apparatus that includes a game piece having an electrically conductive surface within an electric circuit. The circuit includes a power source that is coupled through a first plurality of terminals to a first electromechanical device. The terminals are set to open the electric circuit. The game board also includes a plurality of terminals being positioned at different locations thereon such that when the terminals are contacted by the electrically conductive surface of the game piece, the circuit is completed and the electromechanical device is activated.

The invention also includes the method of playing a game by providing an electric circuit having a plurality of terminals coupled to a power source and an electromechanical device. The terminals are positioned on the game board. A game piece then contacts the terminals to complete an electrical circuit. In response to this circuit being completed, an electromechanical device is activated thereby spraying water at one of the game players.

The invention may also be practiced with a game piece for electrically connecting two terminals on a game board to complete a circuit. The piece includes an elongated outer cylinder having an inside surface and an inner cavity. A disc is disposed within the cavity. An electrically conductive surface is disposed on the bottom surface of the disc. The device also includes a spring means for mechanically coupling the inner disc to the outer cylinder while retaining the disc perpendicular to the outer cylinder's inside surface. The spring means permits the disc to travel within the outer cylinder into a position where the conductive surface contacts the terminals to complete the circuit. The disc may then be released so that the springs means causes the disc to travel back to its original position.

The invention may also be practiced by the method of activating a circuit on a game board by providing an electric circuit with a first and second plurality of terminals. A game piece is provided with a conductive surface having a first shape, and a second game piece having a conductive surface with a shape different than the first shape. A first plurality of terminals on the game board is contacted by the conductive surface of the first piece. A second plurality of terminals on the game board is contacted by the conductive surface of the second piece. An indication is then provided whether the first plurality of terminals has been contacted or whether the second plurality of terminals has been contacted.

DESCRIPTION OF THE PREFERRED EMBODIMENTS

Figure 1:
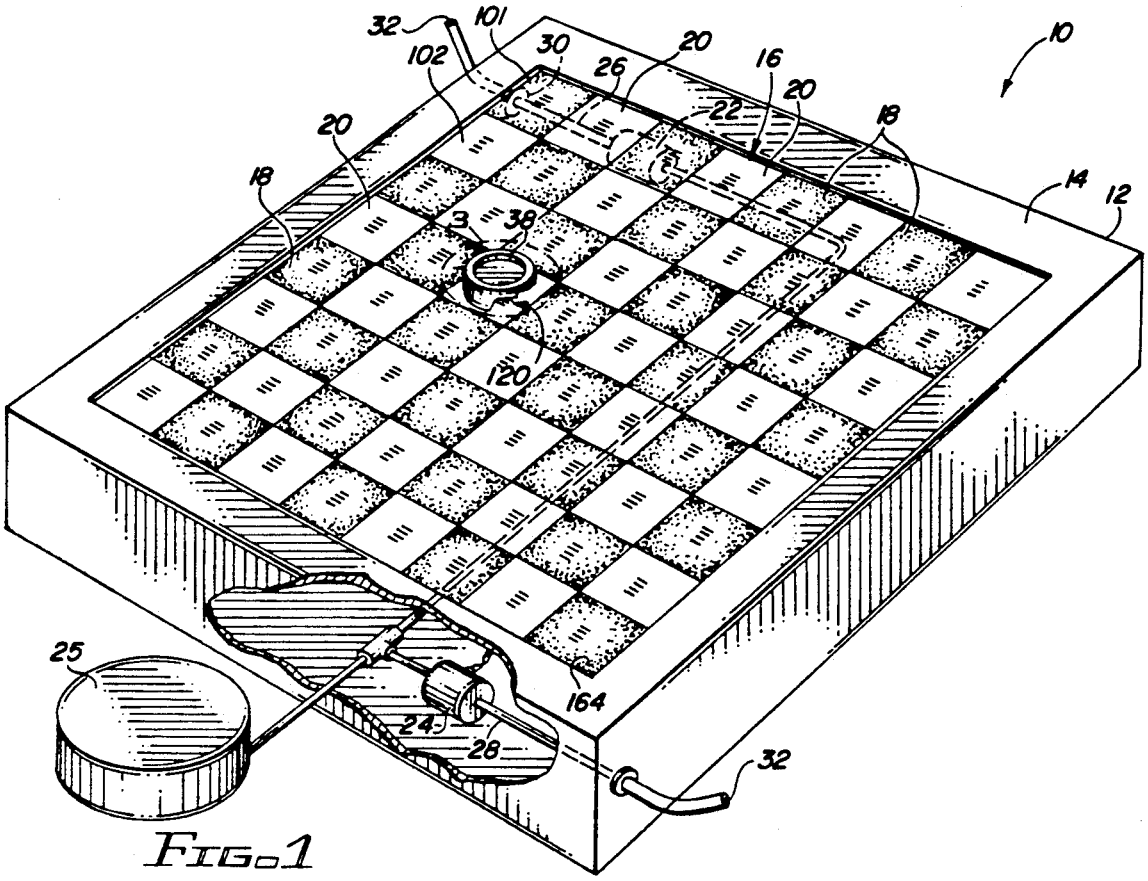
FIG. 1 is a plain view of the game board encompassing the invention.

Referring to FIG. 1 there is shown a game board 10 having a frame 12 connected to top surface 14. Disposed on top surface 14 are squares 16 laid out in an eight by eight grid forming a checkerboard pattern. Squares 16 preferably include dark squares 18 and light squares 20.

Disposed within game board 10 and coupled to frame 12 are electromechanical devices 22 and 24 each coupled through hoses 26 and 28 to nozzles 30 and 32, respectively. Electromechanical devices 22 and 24 preferably include pumps for discharging water through nozzles 30 and 32. Alternately, electromechanical devices 22 and 24 may be an LED, a lighted display, or any other device which responds to electrical signals. Electromechanical devices 22 and 24 are coupled through an electrical circuit (FIG. 2) to terminal sets 101, 102 . . . 164 protruding through top surface 14.

Each of terminals 101-164 are centered on squares 16.

Disposed on one of squares 16 is game piece 38. Details of game piece 38 will be explained herein in connections with FIGS. 3 through 6. Game piece 38 has an electrically conductive surface 40 with a predetermined shape. Game piece 38 may be depressed such that its electrically conductive surface 40 contacts terminals 101-164 within a square 16 to complete an electrical circuit and turn on electromechanical device 22 or electromechanical device 24. The electromechanical device that is turned on is dependent upon which of the terminals within square 16 the electrically conductive surface 40 contacts. When electromechanical device 22 or 24 is activated, water is pumped out of reservoir 25, fed through either nozzle 30 or 32, and directed at one of the game participants.

Figure 2:
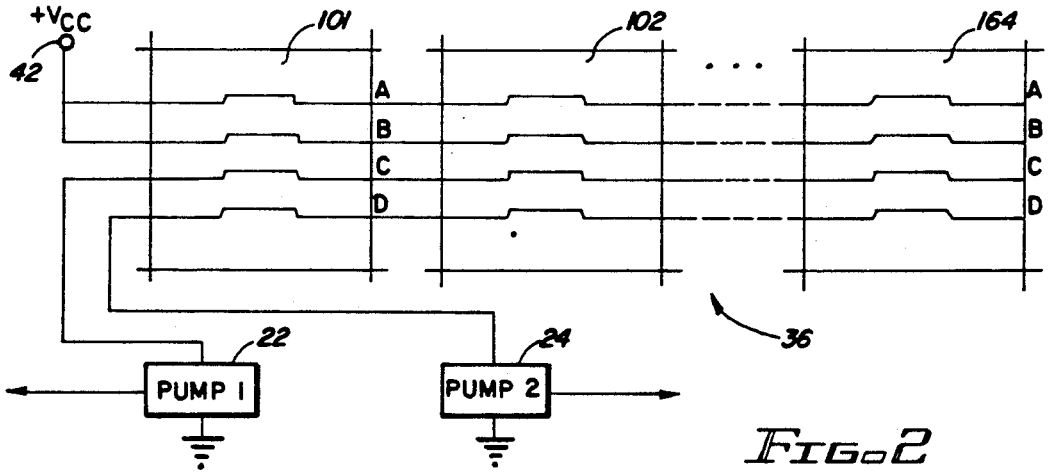
FIG. 2 is a schematic diagram of the electronics based in the game board in FIG. 1.

Referring to FIG. 2, electrical circuit 36 includes terminal sets 101-164, electromechanical devices 22 and 24 and power source 42, such as a battery. The power source 42 is coupled to the A and B terminal of terminal sets 101-164. Electromechanical device 22 is coupled to the C terminal of terminal sets 101-164, and electromechanical device 24 is coupled to the D terminal of terminal sets 101-164.

During operation, the electrically conductive surface 40 will, when game piece 38 is depressed, either connect terminal B to terminal C, or connect terminal A to terminal D. When terminal B connects to terminal C electromechanical device 22 will be activated, when terminal A is connected to terminal D, electromechanical device 24 is enabled. Whether either terminals A and D are connected or terminals B and C are connected will be dependent upon the shape of the electrically conductive surface 40 of game piece 38. Details of the shape will be explained herein.

Figure 3:
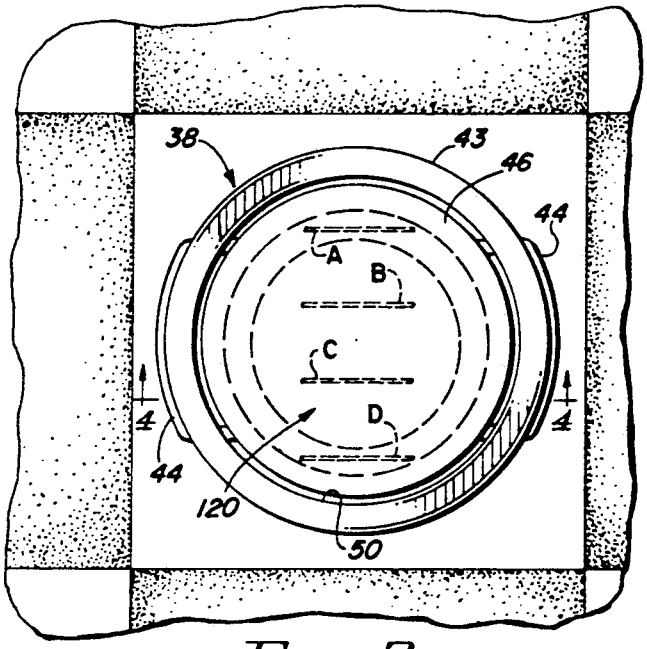
FIG. 3 is a top view of a game piece resting on the game board within lines 3—3 of FIG. 1.
Figure 4:
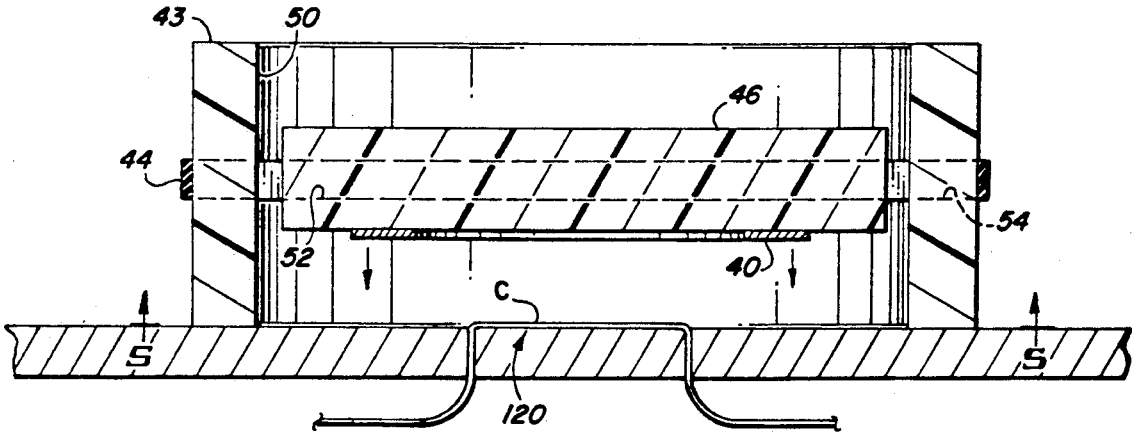
FIG. 4 is a side view of the game piece and game board cut along line 4—4 of FIG. 3.

Referring to FIG. 3 and FIG. 4, there is shown a game piece 38 having an elongated outer cylinder 43 elastically coupled with elastic bands 44 to disc member 46. Disc member 46 is preferably circularly shaped and is disposed on the inside surface 50 of elongated outer cylinder 43. The disc material and outer cylinder material is preferably a plastic, such as PVC or vinyl. Attached with adhesive to the bottom surface of disc member 46 is a conductive material such as aluminum foil or metal.

The disk member 46 preferably has a slit 52 partially around both side of disc member 46. Slit 52 preferably has a width that is wide enough to insert an elastic band 44. Outer cylinder 43 also has a slit on both sides so that elastic band 44 may be inserted into slit 52 in outer cylinder 43, slit 52 in disc member 46 and be wrapped around outer cylinder 43. Elastic band 44 is inserted through slits 52 and slits 54, continuing out and around elongated outer cylinder 43. The size of elastic band 44 is selected so as to completely surround outer cylinder 43, while being inserted into slits 52 and 54. It is preferable that the size of elastic band 44 be selected to support disc member 46 in place on the middle of game piece 38 while allowing disc member 46 to travel downward outer cylinder 43 when depressed. It is also preferable that elastic band 44 be selected to permit disc member 46 to spring back to its original position when disc member 46 is released.

While playing the game on game board 10, one or more game pieces 38 are placed over of one of terminals 101-164. During the game, disc member 46 may be depressed. When disc member 46 is depressed, disc member 46 moves downward so that electrically conductive surface 40 contacts one of terminals 101-164.

Figure 5:
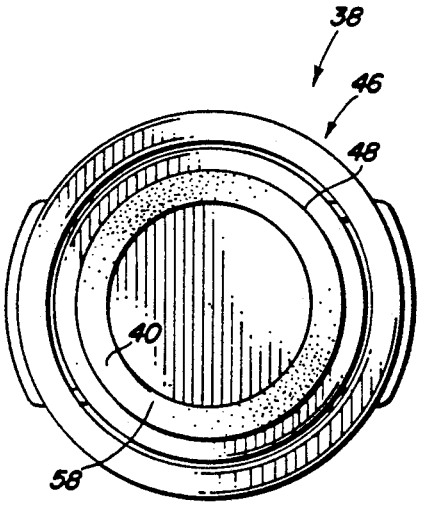
FIG. 5 is a bottom view of the game piece cut along line 5—5 of FIG. 3 showing a disc having a conductive surface shaped to electrically connect the outer terminals on a game board square when the disc is depressed.
Figure 6:
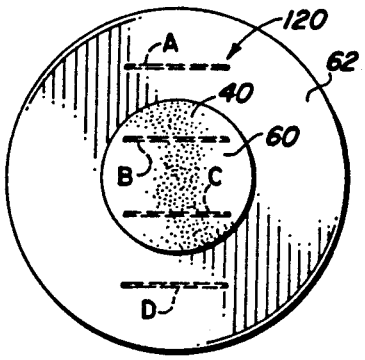
FIG. 6 is a bottom view of another disc that may be incorporated into the game piece shown in FIG. 5 having a conductive surface shaped to electrically connect the middle terminals on a game board square when depressed.

Referring to FIG. 5 and FIG. 6, there is shown disc members 46 and 62, each having different shapes for electrically conductive surface 40. Referring to FIG. 5, disk member 46 has an electrically conductive surface 40 on its bottom surface having a shape in a ring 48 with a void 58 in its middle. Referring to FIG. 6, disc member 62 has electrically conductive surface 40 shaped as a smaller filled-in circle 60 without any voids. Circle 60 has an outer diameter that is smaller than the inner diameter of ring 48 shown in FIG. 5.

During playing of the game, when disc member 46 shown in FIG. 5 is depressed, electrically conductive surface 40 shaped in the form of ring 48 contacts terminals A and D of terminal sets 101-164. When this occurs, electromechanical device 24 is electrically connected to power source 42 and enabled. When electromechanical device 24 is enabled, water is pumped through nozzle 32 at the game player.

On the other hand, when disc member 62 is used on game piece 38 and depressed, circle 60 contacts terminal set 101-164. Disc member 62, when depressed, connects terminals B and D so as to electrically connect electromechanical device 22 to power source 42. This connection enables electromechanical device 22 so as to cause water to be pumped through nozzle 30 at the game player.

It is recognized that by placing the terminals 101-164 adjacent each other while forming the electrically conductive surface 40 in the shape as shown in either FIG. 5 or FIG. 6, the game piece 38 can activate one or more electromechanical devices, regardless of the orientation of the game piece.

Although the current configuration shows the game board 10 with all terminals being connected in order of A-B-C-D, terminal C and D location on squares 16 may be reversed at particular locations on game board 10 to enhance the challenge of playing the game. In a preferred configuration all of the terminals on the light squares 20 have terminals A-B-C-D placed in sequential order. It is also preferable that the terminals be placed on some of the dark squares 20 in order A-B-C-D, and on the remainder of dark square 20 locations it is preferable that the terminals be sequenced A-B-D-C.

This concludes the description of the preferred embodiments. A reading by those skilled in the art will bring to mind various changes without departing from the spirit and scope of the invention. It is intended, however, that the invention only be limited by the following appended claims.

What is claimed is:

1. A game apparatus comprising:

a game piece having an electrically conductive surface;

an electrical circuit including a power source coupled through a first plurality of terminals to a first electromechanical device, said terminals being set to open said electrical circuit;

a game board comprising said plurality of terminals being positioned at different locations thereon such that when said terminals are contacted by the electrically conductive surface of said game piece said first electromechanical device is activated; and wherein said electromechanical device includes pump means for spraying water.

2. A game apparatus comprising:

a game piece having an electrically conductive surface;

an electrical circuit including a power source coupled through a first plurality of terminals to a first electromechanical device, said terminals being set to open said electrical circuit;

a game board comprising said plurality of terminals being positioned at different locations thereon such that when said terminals are contacted by the electrically conductive surface of said game piece said first electromechanical device is activated;

said electrical circuit including a second plurality of terminals that are coupled to said power source and a second electromechanical device; and said second plurality of terminals being positioned on the game board at different locations, such that when said game piece's conductive surface contacts said second plurality of terminals, said electrical circuit is completed and said second electromechanical device is activated.

3. A method of playing a game comprising the steps of:

providing an electrical circuit having a plurality of terminals coupled to a power source and an electromechanical device;

positioning said terminals on a game board;

contacting said terminals on said game board with a game piece;

completing said electrical circuit when said game piece contacts said terminals;

activating said electromechanical device in response to said circuit being completed; and spraying liquid in response to said electromechanical device being activated.

4. A game piece for electrically connecting two terminals on a game board to complete a circuit, the piece comprising:

a elongated outer cylinder having an inside surface encircling a cavity;

a disk disposed within said cavity, said disk having an electrically conductive surface disposed thereon; and spring means extending into said cavity for elastically coupling said disk to said outer cylinder while retaining said disk perpendicular to said outer cylinder's inside surface, and for permitting said disk to travel within said outer cylinder so that said conductive surface contact said terminals to complete the circuit.

5. The game piece as recited in claim 4 wherein said cylinder has an opening at both ends with space sufficient to permit a finger to directly contact said disk.

6. The game piece as recited in claim 4 wherein said cylinder has a top surface with a top edge and a bottom surface with a bottom edge, wherein said top edge is horizontally aligned with said bottom edge when said bottom edge is placed on a gameboard to permit one game piece to be stacked on another game piece.

7. The game piece as recited in claim 4, wherein disk further comprises a slit disposed along the side of said disk for receiving said spring.

8. A method of activating a circuit on a game board comprising:

providing a game board having an electronic circuit with a first and second plurality of terminals;

providing a first game piece having a conductive surface with a first shape;

providing a second game piece having a conductive surface with a second shape different than said first shape;

contacting said first plurality of terminals with the conductive surface of said first piece;

flowing electric current across said conductive surface on said first piece when said first plurality of terminals is contacted by the conductive surface of said first piece;

contacting said second plurality of terminals with the conductive surface of said second piece;

flowing electric current across said conductive surface on said second piece when said second plurality of terminals is contacted by the conductive surface of said second piece; and indicating said first plurality of terminals have been contacted when current flows across said first conductive surface and said second plurality of terminals have been contacted when current flows across said second conductive surface.

9. The method as recited in claim 8 further comprising the step of placing said terminals at a location on the game board where both said first plurality of terminals and second plurality of terminals are simultaneously covered by said game piece when said game piece is placed over said terminals on said game board.

10. The method as recited in claim 8 further comprising the step of forming said first shape in the shape of a first ring and forming said second shape in the shape of a second ring having an outer diameter less than the inner diameter of said first ring.

11. The method as recited in claim 10 further comprising the step of placing said first and second plurality of terminals adjacent each other with the second plurality of terminals being disposed on a line between said first plurality of terminals.

12. The game piece as recited in claim 11 further comprising the steps of placing one of the first plurality of terminals between the second plurality of terminals on preselected gameboard locations and placing one of the second plurality of terminals between the first plurality of terminals at other preselected gameboard locations.

13. A method of activating a circuit on a game board comprising:

providing a game board having an electronic circuit with a first and second plurality of terminals;

providing a first game piece having a conductive surface with a first shape;

providing a second game piece having a conductive surface with a second shape different than said first shape;

contacting said first plurality of terminals with the conductive surface of said first piece;

contacting said second plurality of terminals with the conductive surface of said second piece;

indicating whether either said first plurality of terminals have been contacted or whether said second plurality of terminals have been contacted; and activating a first electromechanical device when said first plurality of terminals has been contacted, and activating a second electromechanical device when said second plurality of terminals has been contacted.

* * * * *